US011642864B2

(12) United States Patent
Pettersson et al.

(10) Patent No.: US 11,642,864 B2
(45) Date of Patent: May 9, 2023

(54) BOX ERECTING METHOD AND SYSTEM

(71) Applicant: PACKSIZE LLC, Salt Lake City, UT (US)

(72) Inventors: Niklas Pettersson, Vasteras (SE); Johan Blomberg, Uppsala (SE)

(73) Assignee: PACKSIZE LLC, Salt Lake City, UT (US)

( * ) Notice: Subject to any disclaimer, the term of this patent is extended or adjusted under 35 U.S.C. 154(b) by 28 days.

(21) Appl. No.: 17/264,808

(22) PCT Filed: Sep. 4, 2019

(86) PCT No.: PCT/US2019/049535
§ 371 (c)(1),
(2) Date: Jan. 30, 2021

(87) PCT Pub. No.: WO2020/096685
PCT Pub. Date: May 14, 2020

(65) Prior Publication Data

US 2021/0283878 A1 Sep. 16, 2021

(30) Foreign Application Priority Data

Sep. 5, 2018 (SE) ..... 1851054-5

(51) Int. Cl.
*B31B 50/34* (2017.01)
*B31B 50/00* (2017.01)
(Continued)

(52) U.S. Cl.
CPC ..... *B31B 50/34* (2017.08); *B31B 50/005* (2017.08); *B31B 50/006* (2017.08); *B31B 50/04* (2017.08);
(Continued)

(58) Field of Classification Search
CPC ..... B31B 50/006; B31B 50/005; B31B 50/04; B31B 50/102; B31B 50/34; B31B 50/624;
(Continued)

(56) References Cited

U.S. PATENT DOCUMENTS 1,809,853 A 6/1931 Knowlton
2,077,428 A 4/1937 Mabon
(Continued)

FOREIGN PATENT DOCUMENTS

CN 2164350 Y 5/1994
CN 1191833 A 9/1998
(Continued)

OTHER PUBLICATIONS

European Search Report for application No. EP17175751 dated Aug. 25, 2017.
(Continued)

*Primary Examiner* — Thomas M Wittenschlaeger
(74) *Attorney, Agent, or Firm* — Workman Nydegger

(57) ABSTRACT

A method for producing boxes and a method for erecting a box from a box template (3), a box erecting system and a box production system, wherein said method for erecting boxes comprises the steps of: folding (S1) two first bottom flaps (28) and two second bottom flaps (29) of the box template (3), which first and second bottom flaps (28, 29) will constitute a bottom of the box when it is erected and which two first bottom flaps (28) are opposing each other and which two second bottom flaps (29) are opposing each other in the box when it is erected; attaching (S2) the box template (3) to a frame (5); rotating (S3) the frame (5) for wrapping the box template (3) around the frame.

31 Claims, 8 Drawing Sheets

(51) Int. Cl.

| | |
|---|---|
| ***B31B 50/04*** | (2017.01) |
| ***B31B 50/10*** | (2017.01) |
| ***B31B 50/62*** | (2017.01) |
| *B31B 110/35* | (2017.01) |

(52) U.S. Cl.
CPC ..... *B31B 50/102* (2017.08); *B31B 50/624* (2017.08); *B31B 2110/35* (2017.08)

(58) Field of Classification Search
CPC ... B31B 50/10; B31B 2110/35; B65B 43/265; B65B 43/39
See application file for complete search history.

(56) References Cited

U.S. PATENT DOCUMENTS 2,083,351 A 6/1937 Sidebotham
2,181,117 A 11/1939 Brenn
2,217,784 A 10/1940 Bennett et al.
2,256,082 A 9/1941 Feurt
2,353,419 A 7/1944 Smithson
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe et al.
2,887,021 A 5/1959 Duffy et al.
2,904,789 A 9/1959 Arthur et al.
2,989,903 A 6/1961 Wilcox
3,057,267 A 10/1962 Johnson, Jr.
3,096,692 A 7/1963 Crathern et al.
3,105,419 A 10/1963 La Bombard
3,108,515 A 10/1963 Stohlquist
3,119,547 A 1/1964 Nute
3,153,991 A 10/1964 Goodrich
3,242,827 A 3/1966 Winters
3,285,145 A 11/1966 Lieberman
3,288,349 A * 11/1966 Palmer ..... B65D 5/10 229/149
3,299,611 A 1/1967 Hendrick et al.
3,303,759 A 2/1967 Burke
3,308,723 A 3/1967 Bergh, Jr.
3,326,096 A 6/1967 Mendoza
3,406,611 A 10/1968 Benjamin et al.
3,418,893 A 12/1968 Stohlquist et al.
3,451,318 A 6/1969 Arnaudon et al.
3,469,508 A 9/1969 Heinz
3,476,023 A 11/1969 Fuller et al.
3,511,496 A 5/1970 Zoglmann
3,566,755 A 3/1971 Smith et al.
3,584,434 A 6/1971 Ellis
3,611,884 A 10/1971 Hottendorf
3,618,479 A 11/1971 Shields
3,628,408 A 12/1971 Rod
3,646,418 A 2/1972 Sterns et al.
3,728,945 A 4/1973 Vuilleumier
3,743,154 A 7/1973 Brewitz
3,748,972 A 7/1973 Barton
3,763,750 A 10/1973 Reichert
3,776,109 A 12/1973 Clark et al.
3,803,798 A 4/1974 Clancy
3,804,514 A 4/1974 Jasinski
3,807,726 A 4/1974 Hope et al.
3,882,764 A 5/1975 Johnson
3,891,203 A 6/1975 Schiff
3,912,389 A 10/1975 Miyamoto
3,913,464 A 10/1975 Flaum
3,949,654 A 4/1976 Stehlin
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A 11/1978 Buschor
4,163,414 A 8/1979 Bachman et al.
4,164,171 A 8/1979 Gorshe et al.
4,173,106 A 11/1979 Garcia et al.
4,184,770 A 1/1980 Pinior
4,191,467 A 3/1980 Schieck
4,221,373 A 9/1980 Muller
4,224,847 A 9/1980 Tokuno
4,261,239 A 4/1981 Toboshi et al.
4,264,200 A 4/1981 Tickner et al.
4,275,543 A 6/1981 Marchetti
4,295,841 A 10/1981 Ward, Jr.
4,320,960 A 3/1982 Ward et al.
4,351,461 A 9/1982 Carlsson
4,368,052 A 1/1983 Bitsky et al.
4,373,412 A 2/1983 Gerber et al.
4,375,970 A 3/1983 Murphy et al.
4,401,250 A 8/1983 Carlsson
4,414,789 A 11/1983 Pattarozzi
4,437,570 A 3/1984 Sorenson
4,449,349 A 5/1984 Roth
4,487,596 A 12/1984 Livens et al.
4,563,169 A 1/1986 Virta et al.
4,578,054 A 3/1986 Herrin
D286,044 S 10/1986 Kando
4,623,072 A 11/1986 Lorenz
4,638,696 A 1/1987 Urwyler
4,662,150 A 5/1987 Johnson et al.
4,695,006 A 9/1987 Pool
4,714,946 A 12/1987 Bajgert et al.
4,743,131 A 5/1988 Atwell
4,749,295 A 6/1988 Bankier et al.
4,773,781 A 9/1988 Bankier
4,838,468 A 6/1989 Lesse
4,844,316 A 7/1989 Keeny
4,847,632 A 7/1989 Norris
4,854,929 A 8/1989 Szuba
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
5,005,816 A 4/1991 Stemmler et al.
5,030,192 A 7/1991 Sager
5,039,242 A 8/1991 Johnson
5,046,716 A 9/1991 Lippold
5,058,872 A 10/1991 Gladow
5,072,641 A 12/1991 Urban et al.
5,074,836 A 12/1991 Fechner et al.
5,081,487 A 1/1992 Hoyer et al.
5,090,281 A 2/1992 Paulson et al.
5,094,660 A 3/1992 Okuzawa
5,105,600 A 4/1992 Depoint et al.
5,106,359 A 4/1992 Lott
5,111,252 A 5/1992 Hamada et al.
5,118,093 A 6/1992 Makiura et al.
5,120,279 A 6/1992 Rabe
5,120,292 A 6/1992 Ueda et al.
5,120,297 A 6/1992 Adami
5,123,890 A 6/1992 Green, Jr.
5,123,894 A 6/1992 Bergeman et al.
5,137,172 A 8/1992 Wagner et al.
5,137,174 A 8/1992 Bell
5,197,366 A 3/1993 Paulson et al.
5,240,243 A 8/1993 Gompertz et al.
5,241,353 A 8/1993 Maeshima et al.
5,263,785 A 11/1993 Negoro et al.
D344,751 S 3/1994 Keong
5,305,993 A 4/1994 Staeb
5,321,464 A 6/1994 Jessen et al.
5,335,777 A 8/1994 Murphy et al.
5,352,178 A 10/1994 Pazdernik
5,358,345 A 10/1994 Damitio
5,369,939 A 12/1994 Moen et al.
5,375,390 A 12/1994 Frigo et al.
5,393,291 A 2/1995 Wingerter
5,411,252 A 5/1995 Lowell
5,584,633 A 12/1996 Scharer
5,586,758 A 12/1996 Kimura et al.

(56) References Cited

U.S. PATENT DOCUMENTS 5,624,369 A 4/1997 Bidlack et al.
5,671,593 A 9/1997 Ginestra et al.
5,716,313 A 2/1998 Sigrist et al.
5,727,725 A 3/1998 Paskvich
5,767,975 A 6/1998 Ahlen
5,836,498 A 11/1998 Turek
5,902,223 A 5/1999 Simmons
5,927,702 A 7/1999 Ishii et al.
5,941,451 A 8/1999 Dexter
5,964,686 A 10/1999 Bidlack et al.
6,000,525 A 12/1999 Frulio
6,071,223 A 6/2000 Reider et al.
6,164,045 A 12/2000 Focke et al.
6,189,933 B1 2/2001 Felderman
6,321,650 B1 11/2001 Ogawa et al.
6,397,557 B1 6/2002 Bassissi et al.
6,428,000 B1 8/2002 Hara et al.
6,471,154 B2 10/2002 Toth
6,553,207 B2 4/2003 Tsusaka et al.
6,568,865 B1 5/2003 Fujioka et al.
6,673,001 B2 1/2004 Toth
6,690,476 B1 2/2004 Hren
6,830,328 B2 12/2004 Cuyler, Jr.
6,837,135 B2 1/2005 Michalski
6,840,898 B2 1/2005 Pettersson
6,910,997 B1 6/2005 Yampolsky et al.
6,913,568 B2 7/2005 Frank et al.
6,968,859 B1 11/2005 Nagano et al.
7,100,811 B2 9/2006 Pettersson et al.
7,115,086 B1 10/2006 Campbell, Jr.
7,121,543 B2 10/2006 Fujioka
7,201,089 B2 4/2007 Richter
7,237,969 B2 7/2007 Bartman
7,390,291 B2 6/2008 Chiu Chen
7,537,557 B2 5/2009 Holler
7,637,857 B2 12/2009 Coullery et al.
7,641,190 B2 1/2010 Hara et al.
7,647,752 B2 1/2010 Magnell
7,648,451 B2 1/2010 Calugi
7,648,596 B2 1/2010 Sharpe et al.
7,690,099 B2 4/2010 Bapst et al.
7,997,578 B2 8/2011 Saito et al.
8,277,367 B2 10/2012 Jannin et al.
D703,246 S 4/2014 Pettersson et al.
8,999,108 B2 4/2015 Nagao et al.
9,069,151 B2 6/2015 Conner
9,120,284 B2 9/2015 Capoia
9,199,794 B2 12/2015 Nadachi et al.
9,227,373 B2 1/2016 Pettersson et al.
9,329,565 B2 5/2016 Osaki
9,352,526 B2 5/2016 Pettersson
9,924,502 B2 3/2018 Choi et al.
9,969,142 B2 5/2018 Pettersson et al.
10,093,438 B2 10/2018 Pettersson
10,286,621 B2 5/2019 Toro
2002/0017754 A1 2/2002 Kang
2002/0066683 A1 6/2002 Sanders
2002/0091050 A1 7/2002 Bacciottini et al.
2002/0115548 A1 8/2002 Lin et al.
2002/0125712 A1 9/2002 Felderman
2002/0139890 A1 10/2002 Toth
2003/0102244 A1 6/2003 Sanders
2003/0217628 A1 11/2003 Michalski
2004/0060264 A1 4/2004 Miller
2004/0082453 A1 4/2004 Pettersson
2004/0092374 A1 5/2004 Cheng
2004/0144555 A1 7/2004 Buekers et al.
2004/0198577 A1 10/2004 Blumle
2004/0261365 A1 12/2004 White
2005/0079965 A1 4/2005 Moshier et al.
2005/0103923 A1 5/2005 Pettersson et al.
2005/0215409 A1 9/2005 Abramson et al.
2005/0280202 A1 12/2005 Vila et al.
2006/0100079 A1 5/2006 Graham et al.
2006/0178248 A1 8/2006 Coullery et al.
2006/0180438 A1 8/2006 Mosli et al.
2006/0180991 A1 8/2006 Nakahata et al.
2006/0181008 A1 8/2006 Van et al.
2007/0079575 A1 4/2007 Monti
2007/0228119 A1 10/2007 Barner
2007/0287623 A1 12/2007 Carlson et al.
2007/0289253 A1 12/2007 Miller
2008/0020916 A1 1/2008 Magnell
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0041534 A1 2/2010 Harding et al.
2010/0111584 A1 5/2010 Shiohara et al.
2010/0206582 A1 8/2010 Meyyappan et al.
2010/0210439 A1 8/2010 Goto
2010/0263333 A1* 10/2010 Langen ..... B65D 5/02 53/563
2011/0026999 A1 2/2011 Kohira
2011/0092351 A1 4/2011 Hatano et al.
2011/0099782 A1 5/2011 Schonberger et al.
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0319242 A1 12/2011 Pettersson
2012/0021884 A1 1/2012 Musha
2012/0028776 A1 2/2012 Pettersson et al.
2012/0100976 A1 4/2012 Graham et al.
2012/0106963 A1 5/2012 Huang et al.
2012/0122640 A1 5/2012 Pazdernik et al.
2012/0122646 A1 5/2012 Murano
2012/0129670 A1 5/2012 Pettersson et al.
2012/0131888 A1 5/2012 Pettersson et al.
2012/0139670 A1 6/2012 Yamagata et al.
2012/0142512 A1 6/2012 Keller
2012/0242512 A1 9/2012 Horstemeyer
2012/0319920 A1 12/2012 Athley et al.
2012/0328253 A1 12/2012 Hurley et al.
2013/0000252 A1 1/2013 Pettersson et al.
2013/0045847 A1 2/2013 Capoia
2013/0104718 A1 5/2013 Tai
2013/0108227 A1 5/2013 Conner
2013/0130877 A1 5/2013 Su
2013/0146355 A1 6/2013 Strasser et al.
2013/0210597 A1 8/2013 Pettersson
2013/0294735 A1 11/2013 Burris et al.
2013/0333538 A1 12/2013 Long et al.
2014/0078635 A1 3/2014 Conner et al.
2014/0091511 A1 4/2014 Martin
2014/0101929 A1 4/2014 Kim et al.
2014/0140671 A1 5/2014 Islam
2014/0315701 A1 10/2014 Pettersson
2014/0336026 A1 11/2014 Pettersson
2014/0357463 A1 12/2014 Kojima
2015/0018189 A1 1/2015 Pettersson et al.
2015/0019387 A1 1/2015 Pettersson et al.
2015/0053349 A1 2/2015 Mori et al.
2015/0055926 A1 2/2015 Strasser et al.
2015/0103923 A1 4/2015 Ramasubramonian et al.
2015/0143777 A1 5/2015 Rapp et al.
2015/0148210 A1 5/2015 Sibthorpe
2015/0155697 A1 6/2015 Loveless et al.
2015/0224731 A1 8/2015 Ponti
2015/0273897 A1 10/2015 Kato et al.
2015/0355429 A1 12/2015 Villegas et al.
2015/0360433 A1 12/2015 Feijen et al.
2015/0360801 A1 12/2015 Sytema
2016/0001441 A1 1/2016 Osterhout et al.
2016/0049782 A1 2/2016 Strasser et al.
2016/0122044 A1 5/2016 Evers et al.
2016/0184142 A1 6/2016 Vanvalkenburgh et al.
2016/0185475 A1* 6/2016 Pettersson ..... B65B 43/10 53/493
2016/0241468 A1 8/2016 Sabella et al.

(56) References Cited

U.S. PATENT DOCUMENTS

| | | | |
|---|---|---|---|
| 2016/0340067 | A1 | 11/2016 | Winkler et al. |
| 2017/0080666 | A1 | 3/2017 | Graham et al. |
| 2017/0355166 | A1 | 12/2017 | Jonker |
| 2017/0361560 | A1 | 12/2017 | Osterhout |
| 2018/0178476 | A1 | 6/2018 | Pettersson et al. |
| 2018/0201465 | A1 | 7/2018 | Osterhout |
| 2018/0265228 | A1 | 9/2018 | Hagestedt et al. |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0329513 | A1 | 10/2019 | Pettersson et al. |
| 2019/0389611 | A1 | 12/2019 | Pettersson |
| 2021/0001583 | A1 | 1/2021 | Osterhout |
| 2022/0032570 | A1 | 2/2022 | Davies et al. |
| 2022/0080691 | A1 | 3/2022 | Osterhout et al. |
| 2022/0144469 | A1 | 5/2022 | Pettersson |

FOREIGN PATENT DOCUMENTS

| | | | |
|---|---|---|---|
| CN | 1366487 | A | 8/2002 |
| CN | 1876361 | A | 12/2006 |
| CN | 102371705 | A | 3/2012 |
| CN | 202412794 | U | 9/2012 |
| CN | 102753442 | A | 10/2012 |
| CN | 102941592 | A | 2/2013 |
| CN | 104169073 | A | 11/2014 |
| CN | 104185538 | A | 12/2014 |
| CN | 104718067 | A | 6/2015 |
| CN | 104812560 | A | 7/2015 |
| CN | 204773785 | U | 11/2015 |
| CN | 106079570 | A | 11/2016 |
| DE | 1082227 | B | 5/1960 |
| DE | 1212854 | B | 3/1966 |
| DE | 2700004 | A1 | 7/1978 |
| DE | 3343523 | A1 | 6/1985 |
| DE | 3825506 | A1 | 2/1990 |
| DE | 19541061 | C1 | 11/1996 |
| DE | 10355544 | A1 | 6/2005 |
| DE | 102005063193 | A1 | 7/2007 |
| DE | 102008035278 | A1 | 2/2010 |
| EA | 013852 | B1 | 8/2010 |
| EP | 0030366 | A1 | 6/1981 |
| EP | 0202998 | A1 | 11/1986 |
| EP | 0234228 | A2 | 9/1987 |
| EP | 0359005 | A1 | 3/1990 |
| EP | 0650827 | A2 | 5/1995 |
| EP | 0889779 | A2 | 1/1999 |
| EP | 0903219 | A2 | 3/1999 |
| EP | 1065162 | A2 | 1/2001 |
| EP | 1223107 | A1 | 7/2002 |
| EP | 1373112 | A1 | 1/2004 |
| EP | 1428759 | A2 | 6/2004 |
| EP | 1997736 | A2 | 12/2008 |
| EP | 1497049 | B1 | 3/2010 |
| EP | 2228206 | A1 | 9/2010 |
| EP | 2377764 | A1 | 10/2011 |
| EP | 3231594 | A1 | 10/2017 |
| FR | 0428967 | A | 9/1911 |
| FR | 1020458 | A | 2/1953 |
| FR | 1592372 | A | 5/1970 |
| FR | 2721301 | A1 | 12/1995 |
| FR | 2770445 | A1 | 5/1999 |
| FR | 2770455 | A1 | 5/1999 |
| FR | 2808722 | A1 | 11/2001 |
| FR | 2814393 | A1 | 3/2002 |
| FR | 2976561 | A1 | 12/2012 |
| GB | 0166622 | | 7/1921 |
| GB | 983946 | A | 2/1965 |
| GB | 0983946 | A | 2/1965 |
| GB | 1362060 | A | 7/1974 |
| GB | 1546789 | A | 5/1979 |
| JP | 49-099239 | A | 9/1974 |
| JP | 50-078616 | A | 6/1975 |
| JP | 51-027619 | A | 3/1976 |
| JP | 55-057984 | A | 4/1980 |
| JP | 56-089937 | A | 7/1981 |
| JP | 59-031140 | A | 2/1984 |
| JP | 59-176836 | A | 10/1984 |
| JP | 61-118720 | A | 6/1986 |
| JP | 61-242837 | A | 10/1986 |
| JP | 01-133164 | A | 5/1989 |
| JP | 02-182443 | A | 7/1990 |
| JP | 03-070927 | A | 3/1991 |
| JP | 06-099526 | A | 4/1994 |
| JP | 06-320648 | A | 11/1994 |
| JP | 07-156305 | A | 6/1995 |
| JP | 08-238690 | A | 9/1996 |
| JP | 08-333036 | A | 12/1996 |
| JP | 2000-323324 | A | 11/2000 |
| JP | 2003-079446 | A | 3/2003 |
| JP | 2003-165167 | A | 6/2003 |
| JP | 2005-067019 | A | 3/2005 |
| JP | 2005-219798 | A | 8/2005 |
| JP | 2006-289914 | A | 10/2006 |
| JP | 2007-185799 | A | 7/2007 |
| JP | 2008-254789 | A | 10/2008 |
| JP | 2009-023074 | A | 2/2009 |
| JP | 2009-132049 | A | 6/2009 |
| JP | 2011-520674 | A | 7/2011 |
| JP | 2011-230385 | A | 11/2011 |
| JP | 2015-160428 | A | 9/2015 |
| RU | 2015030 | C1 | 6/1994 |
| RU | 2037425 | C1 | 6/1995 |
| RU | 2089398 | C1 | 9/1997 |
| RU | 2136503 | C1 | 9/1999 |
| RU | 2180646 | C1 | 3/2002 |
| RU | 2004136918 | A | 5/2006 |
| RU | 2287432 | C2 | 11/2006 |
| RU | 2398674 | C1 | 9/2010 |
| RU | 2531785 | C2 | 10/2014 |
| RU | 2600917 | C2 | 10/2016 |
| SE | 0450829 | B | 8/1987 |
| SE | 450829 | B | 8/1987 |
| SE | 541921 | C2 | 1/2020 |
| SE | 1851054 | A1 | 3/2020 |
| SE | 2050379 | A1 | 3/2020 |
| SE | 543046 | C2 | 9/2020 |
| SU | 1054863 | A1 | 11/1983 |
| SU | 1121156 | A1 | 10/1984 |
| SU | 1718783 | A1 | 3/1992 |
| SU | 1756211 | A1 | 8/1992 |
| WO | 96/14773 | A1 | 5/1996 |
| WO | 97/31773 | A2 | 9/1997 |
| WO | 99/17923 | A1 | 4/1999 |
| WO | 02/79062 | A1 | 10/2002 |
| WO | 03/89163 | A2 | 10/2003 |
| WO | 2009/093936 | A1 | 7/2009 |
| WO | 2010/091043 | A1 | 8/2010 |
| WO | 2011/007237 | A1 | 1/2011 |
| WO | 2011/100078 | A2 | 8/2011 |
| WO | 2011/135433 | A1 | 11/2011 |
| WO | 2012/003167 | A1 | 1/2012 |
| WO | 2013/071073 | A1 | 5/2013 |
| WO | 2013/071080 | A1 | 5/2013 |
| WO | 2013/106180 | A1 | 7/2013 |
| WO | 2013/114057 | A2 | 8/2013 |
| WO | 2014/048934 | A1 | 4/2014 |
| WO | 2014/117816 | A1 | 8/2014 |
| WO | 2014/117817 | A1 | 8/2014 |
| WO | 2014117817 | A1 | 8/2014 |
| WO | 2015/173744 | A1 | 11/2015 |
| WO | 2016/176271 | A1 | 11/2016 |
| WO | 2017/203401 | A1 | 11/2017 |
| WO | 2017/218296 | A1 | 12/2017 |
| WO | 2017/218297 | A1 | 12/2017 |

OTHER PUBLICATIONS

European Search Report for EP10739040 dated Jan. 31, 2013.
European Search Report for EP12848321 dated Jul. 1, 2015.
European Search Report for EP12865028 dated Jul. 7, 2015.

(56) References Cited

OTHER PUBLICATIONS

European Search Report for EP16169030 dated Dec. 16, 2016, dated Jan. 5, 2017.
European Search Report for EP80107577.1 dated Mar. 2, 1981.
European Search Report for EP89115688.7 dated Nov. 2, 1989.
Final Office Action received for U.S. Appl. No. 13/147,787, dated Apr. 17, 2015.
Final Office Action received for U.S. Appl. No. 13/147,787, dated Feb. 16, 2016.
Final Office Action received for U.S. Appl. No. 13/147,787, dated Mar. 7, 2017.
Final Office Action received for U.S. Appl. No. 14/357,183, dated Nov. 12, 2015.
Final Office Action received for U.S. Appl. No. 14/357,190, dated Aug. 1, 2017.
Final Office Action received for U.S. Appl. No. 14/370,729, dated Jul. 12, 2017.
International Search Report and Wirtten Opinion for application No. PCT/US2012/070719 dated Feb. 25, 2013.
International Search Report and Written Opinion for application No. PCT/US2017/036603 dated Oct. 18, 2017.
International Search Report and Written Opinion for application No. PCT/US2017/036606 dated Oct. 24, 2017.
International Search Report and Written Opinion for PCT/US18/14275 dated Apr. 4, 2018.
International Search Report and Written Opinion for PCT/US19/62696 dated Feb. 4, 2020.
International Search Report and Written Opinion for PCT/US2015/67375 dated Mar. 11, 2016.
International Search Report and Written Opinion for PCT/US2019/049102 dated Dec. 2, 2019.
International Search Report and Written Opinion from International Application No. PCT/US2010/022983 dated Apr. 13, 2010.
International Search Report and Written Opinion issued in PCT/US2018/020928 dated Jun. 7, 2018.
International Search Report and Written Opinion issued in PCT/US2019/038142 dated Aug. 19, 2019.
International Search Report and Written Opinion PCT/IB2019/052793 dated Nov. 11, 2019.
International Search Report and Written Opinion PCT/IB2019/052794 dated Jun. 19, 2019.
International Search Report and Written Opinion received for PCT Patent Application No. PCT/US2018/020928, dated Jun. 7, 2018, 9 pages.
International Search Report and Written Opinion received for PCT Patent Application No. PCT/US2019/049535, dated Jun. 9, 2020, 14 pages.
International Search Report and Written Opinion received for PCT Patent Application No. PCT/US2020/012519, dated Jun. 26, 2020, 19 pages.
International Search Report and Written Opinion received for PCT Patent Application No. PCT/US2020/012519, dated Jun. 26, 2020, 20 pages.
International Search Report and Written Opinion, PCT/US2012/064403, US Search Authority, Completed Mar. 26, 2013, dated Apr. 8, 2013.
International Search Report and Written Opinion, PCT/US2012/064414, US Search Authority, Completed Jan. 4, 2013, dated Jan. 25, 2013.
International Search Report for PCT/US2011/042096 dated Oct. 28, 2011.
Japanese Office Action for application No. 2017-000038 dated Sep. 22, 2017.
Non-Final Office Action received for U.S. Appl. No. 16/224,708, dated Jan. 15, 2021, 19 pages.
Office Action received for U.S. Appl. No. 13/147,787, dated Aug. 27, 2014.
Office Action received for U.S. Appl. No. 13/147,787, dated Oct. 28, 2016.
Office Action received for U.S. Appl. No. 13/147,787, dated Sep. 30, 2015.
Office Action received for U.S. Appl. No. 13/805,602, dated Dec. 2, 2015.
Office Action received for U.S. Appl. No. 14/357,183, dated Jul. 16, 2015.
Office Action received for U.S. Appl. No. 14/357,190, dated Feb. 17, 2017.
Office Action received for U.S. Appl. No. 14/370,729, dated Dec. 19, 2017.
Office Action received for U.S. Appl. No. 14/370,729, dated Jan. 26, 2017.
Office Action received for U.S. Appl. No. 14/970,224, dated May 30, 2018.
Office Action received for U.S. Appl. No. 15/616,688, dated Mar. 19, 2020.
Office Action received for U.S. Appl. No. 15/872,770, dated Mar. 27, 2020.
Office Action received for U.S. Appl. No. 15/901,089, dated Apr. 13, 2020.
Office Action received for U.S. Appl. No. 16/109,261, dated Apr. 28, 2020.
Office Action received for U.S. Appl. No. 29/419,922, dated Aug. 6, 2013.
U. S. Patent Application mailed on Dec. 14, 2018, filed by Pettersson et al., U.S. Appl. No. 16/310,406.
U. S. Patent Application mailed on Jan. 16, 2018 filed by Osterhout, U.S. Appl. No. 15/872,770.
U.S. Provisional Application mailed on Jan. 18, 2017, filed by Osterhout, U.S. Appl. No. 62/447,714.
Final Office Action received for U.S. Appl. No. 16/224,708, dated May 5, 2021, 24 pages.
International Search Report and Written Opinion issued in PCT/US2019/049535 dated Jun. 9, 2020.
Non-Final Office Action received for U.S. Appl. No. 15/872,770, dated Nov. 10, 2020, 24 pages.
Non-Final Office Action received for U.S. Appl. No. 16/310,406, dated Aug. 19, 2020, 22 pages.
Non-Final Office Action received for U.S. Appl. No. 16/491,088, dated Aug. 5, 2021, 11 pages.
Non-Final Office Action received for U.S. Appl. No. 17/416,811, dated Apr. 27, 2022, 9 pages.
Notice of Allowance and Fees Due (PTOL-85) dated Aug. 27, 2021 for U.S. Appl. No. 16/224,708.
Notice of Allowance and Fees Due (PTOL-85) dated Jul. 8, 2021 for U.S. Appl. No. 16/224,708.
Notice of Allowance and Fees Due (PTOL-85) dated Sep. 9, 2021 for U.S. Appl. No. 16/224,708.
Notice of Allowance and Fees Due (PTOL-85) dated Sep. 28, 2021 for U.S. Appl. No. 16/224,708.
Non-Final Office Action received for U.S. Appl. No. 17/586,517, dated Jan. 20, 2023, 14 pages.

* cited by examiner

BOX ERECTING METHOD AND SYSTEM

CROSS-REFERENCE TO RELATED APPLICATIONS

This application claims priority to PCT Application No. PCT/US2019/049535, filed Sep. 4, 2019, entitled "A BOX ERECTING METHOD AND SYSTEM", which claims priority to and the benefit of Sweden Patent Application No. 1851054.5 filed Sep. 5, 2018, entitled "A BOX ERECTING METHOD AND SYSTEM". All the aforementioned applications are incorporated by reference herein in their entirety.

TECHNICAL FIELD OF THE INVENTION

The present invention relates to a box erecting method and system and to a box production method and system.

RELATED ART

Erecting boxes from box templates in for example shipping and packaging industries can be done manually and/or with help from some erecting tools. These tools could for example comprise vacuum tools for gripping certain parts of a box template while folding other parts, such as for example a bottom of the box. Automatic erecting of boxes may encounter problems for example when different sizes of boxes should be erected with use of the same tools and/or if the box walls are not as stable as required, for example due to folds provided in the templates due to a fanfold storage of the template material.

Shipping and packaging industries frequently use cardboard and other sheet material processing equipment that converts sheet materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

A typical box template production system includes a converting part that cuts, scores, and/or creases sheet material to form a box template. The sheet material can be provided to the system from fanfolded bales. The fanfold storage of the sheet material provides unwanted fanfold folds to the box templates. These folds could be a problem when erecting the boxes, especially if tools for automatic erection are used.

SUMMARY OF THE INVENTION

It is an object of the present invention to provide an improved method and system for erecting boxes.

It is a further object of the invention to provide a method and a system for erecting boxes which is automated and flexible.

This is achieved in a method and a system for erecting boxes according to the independent claims.

In one aspect of the invention a method for erecting a box from a box template is provided. Said method comprising the steps of:

- folding two first bottom flaps and two second bottom flaps of the box template, which first and second bottom flaps will constitute a bottom of the box when it is erected and which two first bottom flaps are opposing each other and which two second bottom flaps are opposing each other in the box when it is erected;
- attaching the box template to a frame;
- rotating the frame for wrapping the box template around the frame.

In another aspect of the invention a box erecting system for erecting a box from a box template is provided. Said box erecting system comprises:

- a frame;
- an attaching device connected to the frame and configured for attaching the frame to a first end of a box template to be erected;
- a control system connected to said frame and configured for rotating said frame for wrapping a box template attached to the frame around the frame;
- a first guiding device arranged in the box erecting system for folding two first bottom flaps and two second bottom flaps of the box template before the box template is wrapped around the frame, which first and second bottom flaps will constitute a bottom of the box when it is erected and which two first bottom flaps are opposing each other and which two second bottom flaps are opposing each other in the box when it is erected.

Hereby, a reliable process for erecting boxes is achieved. Thanks to the folding of the bottom flaps before wrapping the box around the frame possible problems in stability of side walls of the box arising from for example the storing method of the sheet material, for example fanfold bales or rolls, can be avoided. When wrapping the box template around the frame fanfold folds or instability of the material caused by roll storing could sometimes cause that the box template side corners do not fit snug around the frame as planned. When the bottom flaps are folded before the wrapping the stability of the box template will be much better and problems during wrapping possibly caused by the fanfold folds will be much decreased.

A further object of the invention is to provide an improved method and a system for producing boxes.

This is achieved by a method for producing boxes from sheet material, said method comprising the steps of:

producing box templates from sheet material;

erecting the box templates according to the method as described above.

This is also achieved by a box production system comprising:

at least one inlet for receiving sheet material;

at least one converter part configured for receiving said sheet material and convert said sheet material into box templates according to given instructions;

at least one box erecting system as described above, which is configured for erecting box templates provided from the at least one converter part.

Hereby boxes can be produces efficiently. An automatic or partly automatic erection of the boxes can be provided close to a box production system.

In one embodiment of the invention the step of folding two first bottom flaps and two second bottom flaps comprises folding the two first bottom flaps a different amount of degrees than the two second bottom flaps are folded. Hereby the box template can be wrapped around the frame without the bottom flaps colliding.

In one embodiment of the invention the step of folding first and second bottom flaps of the box template comprises advancing the box template through a feeding part of a box erecting system towards the frame such that a first guiding device provided in the feeding part will force the first and second bottom flaps to fold between 60 and 90 degrees in relation to an adjacent side wall part of the box template.

In one embodiment of the invention the method further comprises a step performed before wrapping the box template around the frame:

folding two first top flaps and two second top flaps of the box template, which first and second top flaps will constitute a top of the box when it is erected and closed and which two first top flaps are opposing each other and which two second top flaps are opposing each other in the box when it is erected, wherein the first and second top flaps are folded in relation to an adjacent side wall part of the box template and in an opposite direction compared to the folding of the bottom flaps.

In one embodiment of the invention the method further comprises the step of:

adjusting a size of the frame according to a size of the box template before the box template is wrapped around the frame.

Hereby boxes of different sizes can be erected.

In one embodiment of the invention the step of adjusting the size of the frame comprises controlling the size of the frame by a control system connected to the frame, wherein said adjusting comprises controlling by the control system distances between four corner posts provided in the frame.

In one embodiment of the invention the method further comprises the step of:

adjusting a position of a first and possibly also a second guiding device of a feeding part of a box erecting system before the box template is advanced through the feeding part, said position is adjusted according to a height of side walls of the box template, which height corresponds to a height of the finally erected box.

In one embodiment of the invention the box erecting system further comprises an advancing device provided in a feeding part of the box erecting system for advancing the box template along a path of the feeding part towards the frame, wherein the frame is provided at an outlet side of the feeding part and wherein the first guiding device is provided to said feeding part such that the first guiding device will force the first and second bottom flaps to fold between 60 and 90 degrees in relation to an adjacent side wall part of the box template when the box template is fed through the feeding part.

In one embodiment of the invention the box erecting system further comprises at least one actuator provided to the feeding part and configured for providing an additional amount of folding to either the two first bottom flaps or the two second bottom flaps when the box template is fed through the feeding part.

In one embodiment of the invention the box erecting system further comprises a second guiding device provided in a feeding part of the box erecting system and configured for folding two first top flaps and two second top flaps of the box template before the box template is wrapped around the frame, which first and second top flaps will constitute a top of the box when it is erected and closed and which two first top flaps are opposing each other and which two second top flaps are opposing each other in the box when it is erected, wherein the first and second top flaps are folded in relation to an adjacent side wall part of the box template and in an opposite direction compared to the folding of the bottom flaps.

Further embodiments are described in the dependent claims.

DETAILED DESCRIPTION OF THE EMBODIMENTS

According to the invention a box erecting system and a method for erecting boxes from box templates are provided. A box erecting system 1 according to one embodiment of the invention is shown in FIGS. 1 and 2. Furthermore a box production system and a method for producing boxes from sheet material are provided. A box production system 100 comprising a box erecting system 1 according to one embodiment of the invention is shown schematically in FIGS. 3*a*-3*d*.

The method and system according to the invention can be applied for different types of boxes, for example a so called Regular Slotted Container, RSC, also called Fefco 201 or American box or a Half Slotted Container HSC, also called Fefco 200.

Figure 1A:
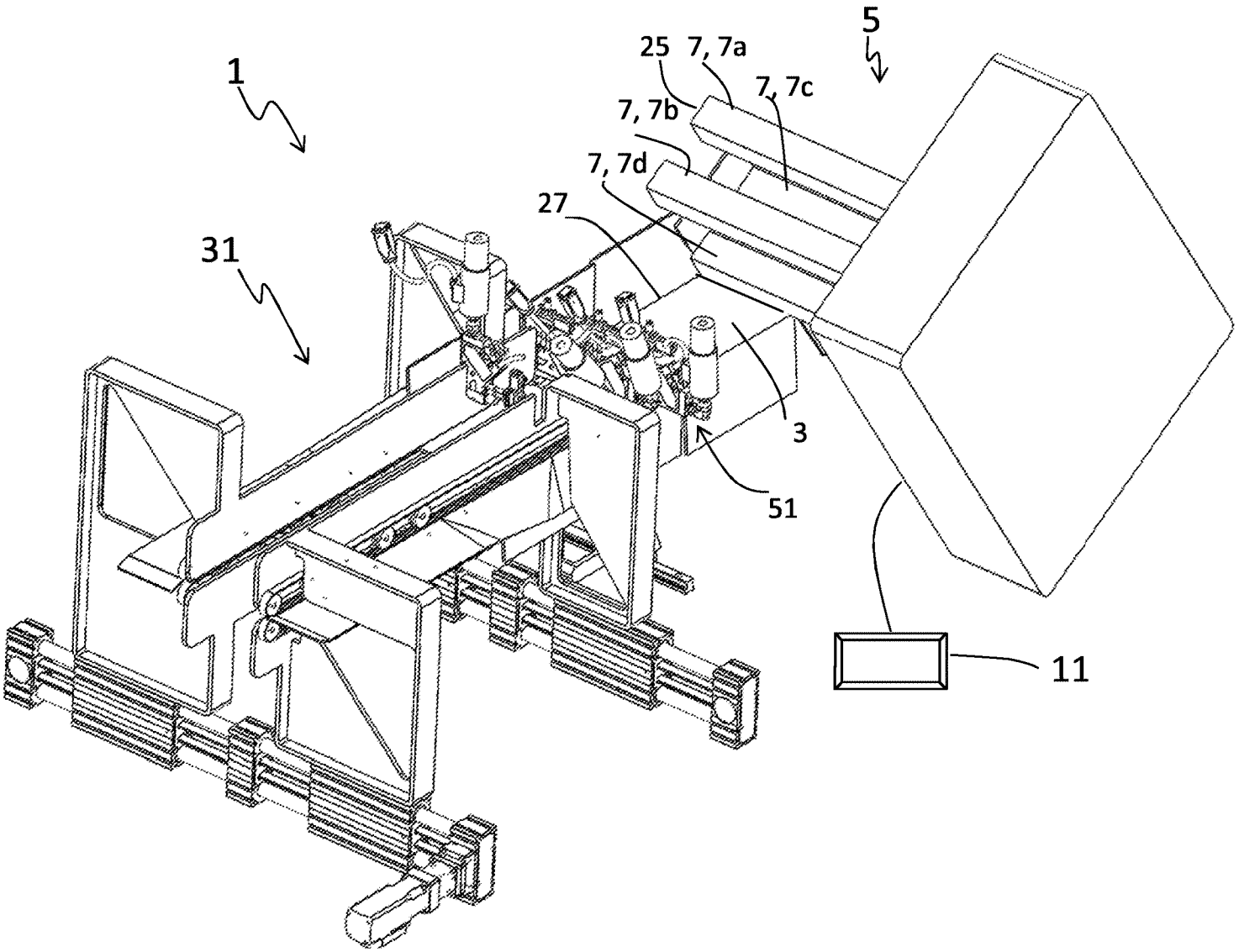
FIGS. 1*a*-1*c* are perspective views of a box erecting system according to one embodiment of the invention.
Figure 1B:
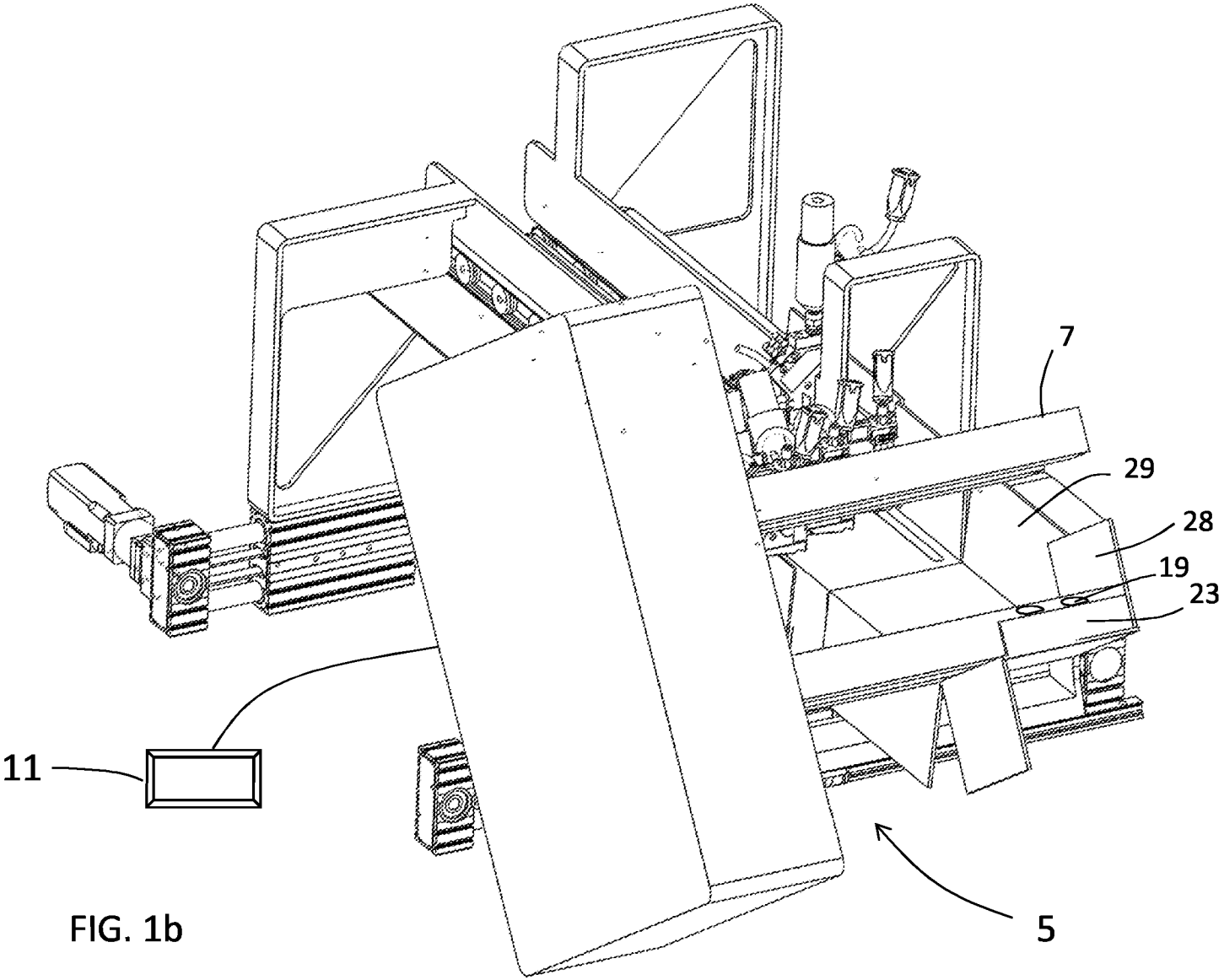
Figure 1C:
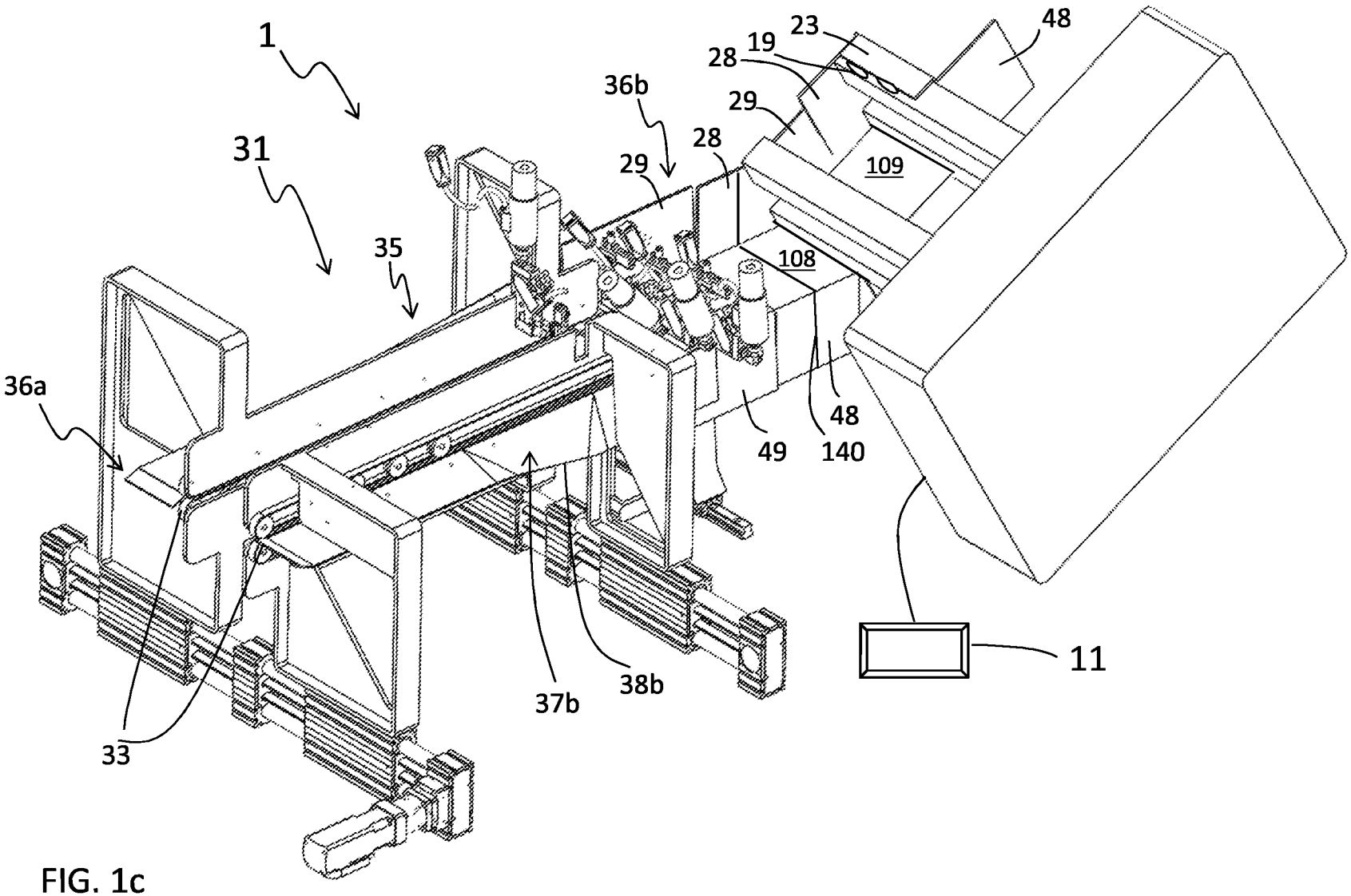
Figure 2B:
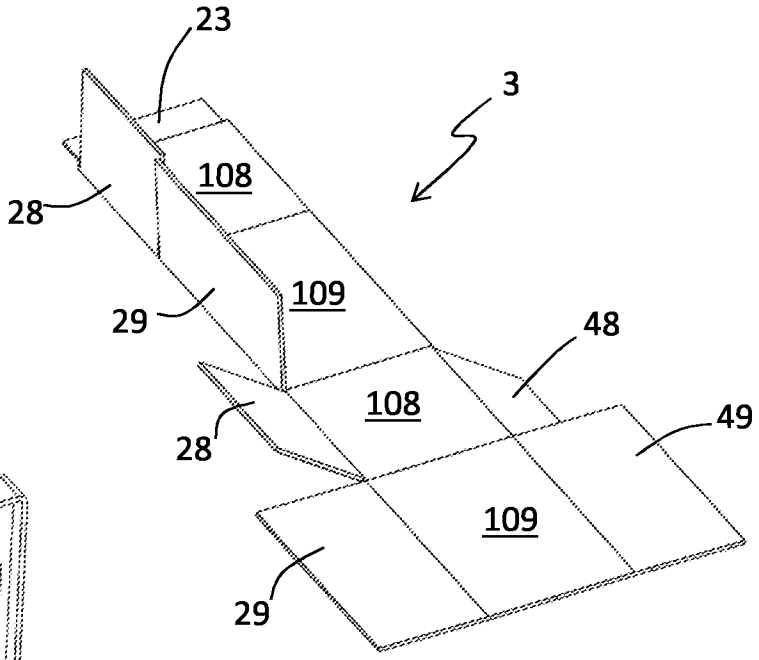
FIG. 2*b* shows schematically the form of a box template on its way through the box erecting system as shown in FIG. 2*a*.

FIGS. 1*a*-1*c* show schematically a box erecting system 1 according to one embodiment of the invention in different views and in different positions. The box erecting system 1 comprises a frame 5 and a control system 11 connected to said frame 5. The frame 5 comprises in this embodiment adjustable parts 7, which are defining the size of the frame 5. In this embodiment of the invention the adjustable parts 7 comprises four corner posts 7 and the control system 11 is configured for controlling the position of said corner posts 7 in accordance with different box template sizes, i.e. in accordance with different box sizes to be erected. The four corner posts 7 are positioned to form a rectangular shape corresponding to a rectangular shape of the box to be erected. Each corner post 7 will in one embodiment of the invention be provided in a corner between two side walls of the erected box. An adjustment of the size of the frame can in one embodiment of the invention be to adjust the distances between the corner posts which distances corresponds to a width and a length of the box to be erected. In this embodiment of the invention at least one of the corner posts 7 comprises an attachment device 19 to which a first end 23 of a box template 3 can be attached during wrapping of the box template around the frame 5. This could for example be a suction cup or a clamp which can be controlled from the control system 11. In the embodiment shown in FIGS. 1*a*-1*c* a first end 23 of the box template is a glue tab provided for forming part of a manufacturer's joint. However in another embodiment of the invention an overlap manufacturer's joint is not necessary but instead an edge to edge manufacturer's joint using tape sealing could be provided. In that case a first end 23 of the box template which is attached to one of the corner posts 7 is not a glue tab but simply the outermost end of the box template.

In this embodiment of the invention the control system 11 is configured for controlling the position of the frame 5 for wrapping the box template 3 around the frame 5. The control system 11 can control the attaching device 19 provided to at least one of the corner posts 7 to attach to a first end 23 of a box template 3 to be erected. The control system 11 is configured to rotate the frame 5 for wrapping the box template 3 around the frame 5.

The box erecting system 1 comprises furthermore a feeding part 31 which is configured for feeding the frame 5 with a box template 3. The feeding part 31 can possibly be provided in direct connection to a box template production system, for example directly at an outlet 43 from a converting part 41 of a box template production system. This is schematically illustrated in FIGS. 3*a*-3*d* where a box production system 100 is illustrated. The box production system 100 comprises a converter part 41 and a box erecting system 1 positioned in connection with an outlet 43 from the converter part 41. Sheet material is fed into the converter part 41 at an inlet 45 of the converter part 41 for example from sheet material stored in fanfold bales (not shown). Hereby a box template 3 is delivered out from the converter part 41 and into the feeding part 31 of the box erecting system 1. The feeding part 31 is only schematically shown in FIGS. 3*a*-3*d* but shown in more detail in FIGS. 1 and 2. The feeding part 31 comprises an advancing device 33 which is configured for advancing the box template 5 along a path 35 towards the frame 5. The path 35 is a surface for the box template 3 to lie on which path 35 is reaching between an inlet side 36*a* of the feeding part 31 and an outlet side 36*b* of the feeding part, wherein the outlet side 36*b* is positioned in connection with the frame 5. According to the invention the feeding part 31 of the box erecting system 1 comprises a first guiding device 37*a* arranged in the system for folding two first bottom flaps 28 and two second bottom flaps 29 of the box template 3 before the box template is wrapped around the frame 5. The first and second bottom flaps 28, 29 will constitute a bottom of the box when it is erected and which two first bottom flaps 28 are opposing each other in the box when it is erected and can also be called minor flaps and which two second bottom flaps 29 are opposing each other in the box when it is erected and can be called major flaps.

Figure 2A:
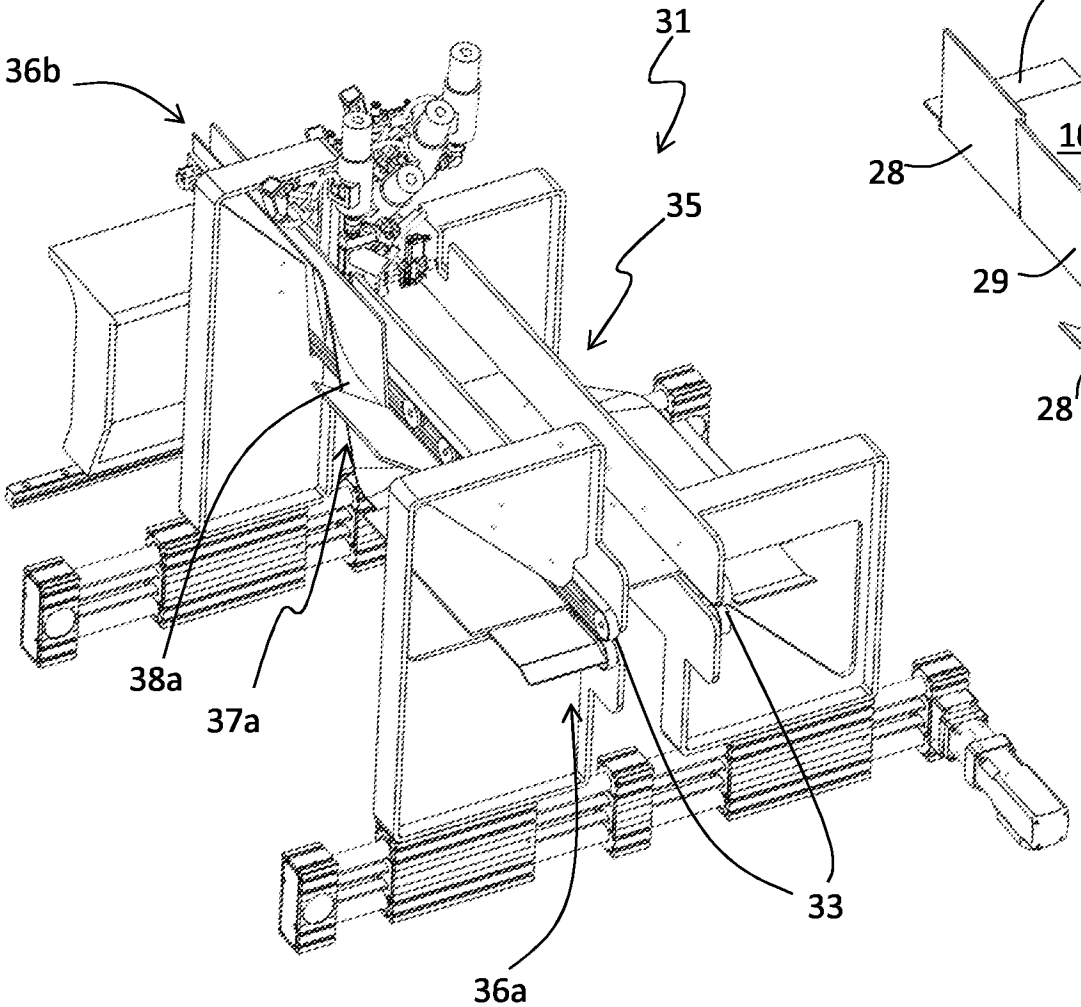
FIG. 2*a* is a perspective view of one part of the box erecting system as shown in FIGS. 1*a*-1*c*.
Figure 2C:
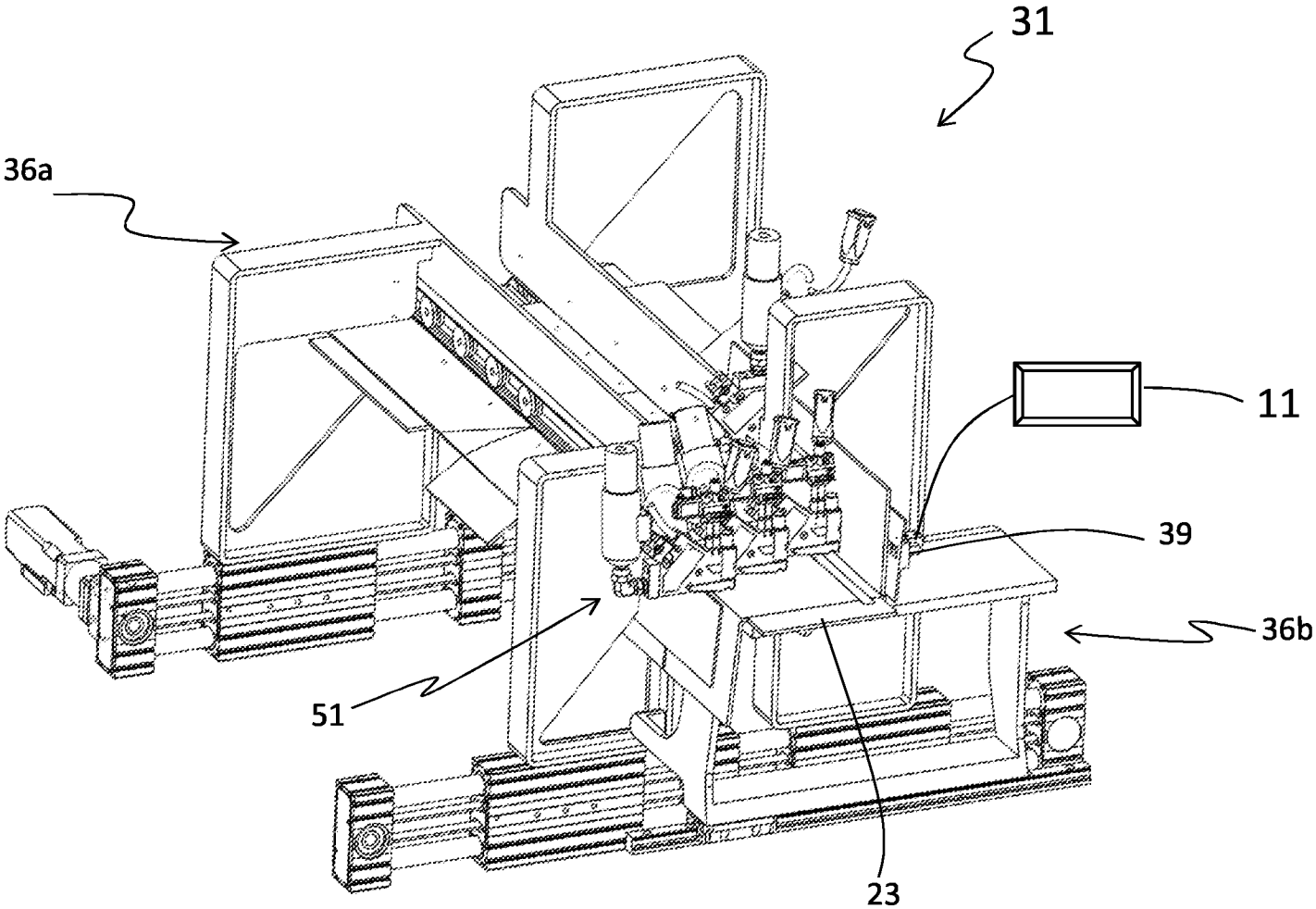
FIG. 2*c* is a perspective view of the same part of the box erecting system as shown in FIG. 2*a* but from the other side.

The first guiding device 37*a* can best be seen in FIG. 2*a* and is in this embodiment a bent sheet metal which is provided along the path 35 and comprises a guiding surface 38*a* which is curved and which will force the first and second bottom flaps 28, 29 to be bent upwards in an amount of between 60-90 degrees, or in one embodiment 80-90 degrees, in relation to a plane in which an adjacent side wall part 108, 109 of the box template 3 is provided when transferred through the feeding part 31. Hereby the first and second bottom flaps 28, 29 will be bent in relation to an adjacent part of the box template 3 during a feeding of the box template 3 through the feeding part 31 towards the frame 5.

Hereby the bottom flaps 28, 29 are already folded when the box template 3 arrives at the frame 5 for wrapping of the box template 3 around the frame 5. This is suitable because any possible fanfold folds in the box template caused by the storage of the sheet material in z-folds can make sides of the box less stable and robust than sides without fanfolds. When erecting boxes such fanfold folds may cause problems, especially when boxes are erected automatically. By first folding bottom flaps 28, 29, box sides comprising fanfold folds will be stabilized and the erection of boxes will be facilitated, i.e. a more reliable and robust box erecting system will be achieved. Other storage methods such as for example rolls of sheet material can also cause instability of the side walls. The folding of the bottom flaps according to the invention will increase stability of the side walls also in this case.

In one embodiment of the invention at least one actuator 39 is furthermore provided in the feeding part 31. This actuator 39 can be seen in FIG. 2*c*. The actuator 39 is connected to the control system 11 and is configured for providing an additional amount of folding to either the two first bottom flaps 28 or the two second bottom flaps 29. Hereby either the two first bottom flaps 28 will during the wrapping of the box template 3 around the frame 5 be provided inside the two second bottom flaps 29 or the other way around. This is suitable in order to provide a convenient wrapping of the box template without the bottom flaps 28, 29 colliding. The control system 11 will be aware of which one of the bottom flaps 28, 29 currently being in the position where the actuator 39 is provided and can hereby control the actuator 39 to only fold either the first or the second bottom flaps 28, 29 an additional amount. An additional amount can for example be a few degrees. In FIG. 2*b* the box template 3 is shown as it is provided in one specific position during its passage through the feeding part 31. In this position one of the first bottom flaps 28*a* has just been folded an additional amount by the actuator 39 which can be seen in that it is folded more than the second bottom flap 29 which is provided adjacent. The other first bottom flap 28*b* has just started to be forced to fold by the first guiding device 37*a*.

In this embodiment, but not necessarily, the feeding part 31 of the box erecting system 1 further comprises a second guiding device 37*b* (best seen in FIG. 1*c*) which is similar to the first guiding device 37*a* but inverted. I.e. the second guiding device 37*b* can be a bent sheet metal which is provided along the path 35 and comprises a guiding surface 38*b* which is curved and which will force first and second top flaps 48, 49 to be bent downwards in relation to a plane in which an adjacent side wall part 108, 109 of the box template 3 is provided when transferred through the feeding part 31. Hereby the first and second top flaps 48, 49 will be bent in relation to an adjacent side wall part of the box template 3 during a feeding of the box template 3 through the feeding part 31 towards the frame 5.

Hereby the two first top flaps 48 and the two second top flaps 49 of the box template 3 are folded before the box template 3 is wrapped around the frame 5. The first and second top flaps 48, 49 will constitute a top of the box when it is erected and closed and the two first top flaps 48 are opposing each other and the two second top flaps 49 are opposing each other in the box when it is erected. The first and second top flaps 48, 49 are folded in an opposite direction compared to the folding of the bottom flaps 28, 29. The amount of folding can for the top flaps be anything between 0-180 degrees. Also a small folding will increase the stability. Folding of the top flaps also provides further advantages such as easier filling of the erected box, easier transportation of the erected box towards a filling station and the corner posts 7 of the frame 5 do not need to be excessively long for holding the box when wrapped around the frame.

The box erecting system 1 comprises furthermore in one embodiment of the invention a gluing device 51 configured for providing glue to a first end 23 or a second end 24 of the box template 3 for the sealing of a manufacturer's joint and to the first or the second bottom flaps 28, 29 before the box template 3 has been completely wrapped around the frame 5. The box erecting system 1 may also comprise a compressing device configured for compressing the first bottom flaps 28 towards the second bottom flaps 29 to seal the bottom.

As described above a manufacturer's joint and a bottom of the box can be sealed for example by tape or by glue before the frame 5 is removed from the erected box and used for erecting a new box.

In this embodiment of the invention the frame 5 comprises four corner posts 7*a*, 7*b*, 7*c*, 7*d*. If for example a Regular Slotted Container, RSC, or a Half Slotted Container, HSC, is erected each one of the four corner posts 7*a*-7*d* will be provided in an inside corner each of the box between two side walls of the box. Furthermore a distance between a first one of the corner posts 7*a* and a second one of the corner posts 7*b* corresponds to a width of the finally erected box and a distance between the first corner post 7*a* and a third corner post 7*c* corresponds to a length of the finally erected box. When adjusting the size of the frame the distances between the corner posts are changed which distances correspond to the length and width of the finally erected box. The feeding part 31 of the box erecting system 1 can also suitably be adapted for different box template sizes. The position of the first and second guiding devices 37*a*, 37*b* will be adjusted according to a height of side walls 108, 109 of the box template, which corresponds to a height of the finally erected box. Also as described above at least one of the corner posts 7 comprises an attachment device 19 to which a first end 23 of a box template 3 can be attached during wrapping of the box template around the frame 5. In the embodiments as shown in FIGS. 1-3 a first end 23 of the box template is a glue tab provided for forming part of a manufacturer's joint. However, as described above the first end 23 does not need to be a glue tab.

Furthermore, in this embodiment it can be seen that the control system 11 is configured for providing the frame 5 to the box template 3 with a distal end 25 of the frame 5 substantially in line with bottom flap creases 27 of the box template 3 such that a bottom can be folded while keeping the frame 5 inside the wrapped box template.

In this embodiment of the invention the control system 11 is configured for controlling the position and orientation of the frame 5 for wrapping the box template 3 around the frame 5. The control system 11 can control the attaching device 19 provided to at least one of the corner posts 7 to attach to a first end 23 of a box template 3 to be erected. The control system 11 is further in this embodiment configured to rotate the frame 5 for wrapping the box template 3 around the frame 5.

Figure 3A:
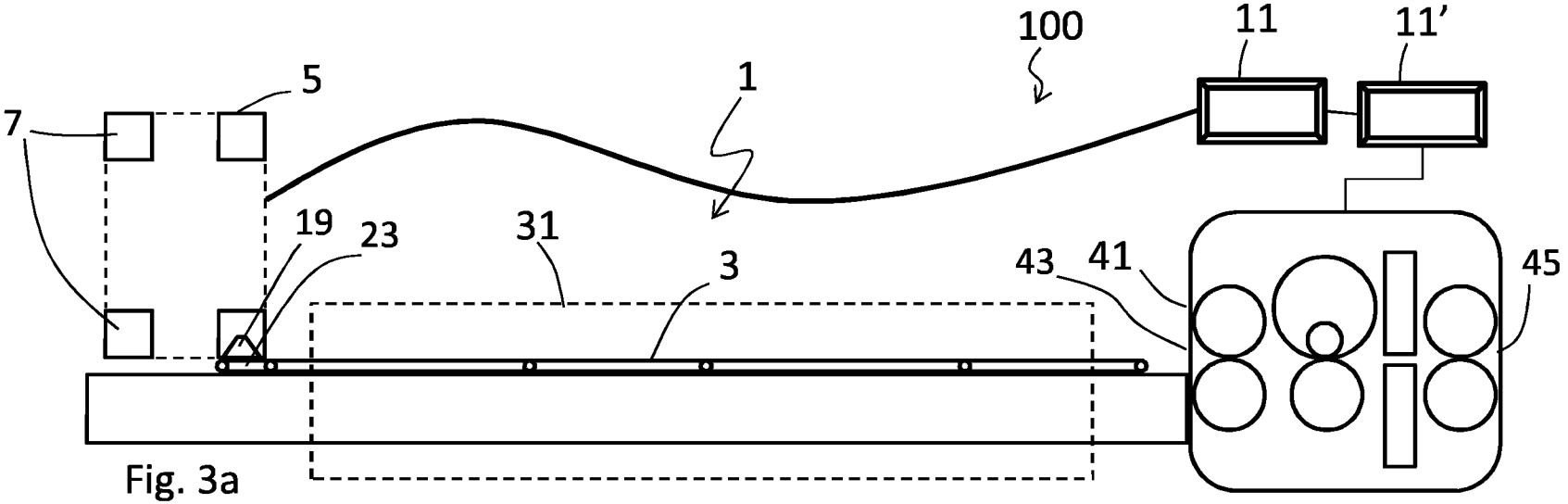
FIGS. 3*a*-3*d* show schematically a box production system according to one embodiment of the invention in four different positions for wrapping a box around a frame.
Figure 3B:
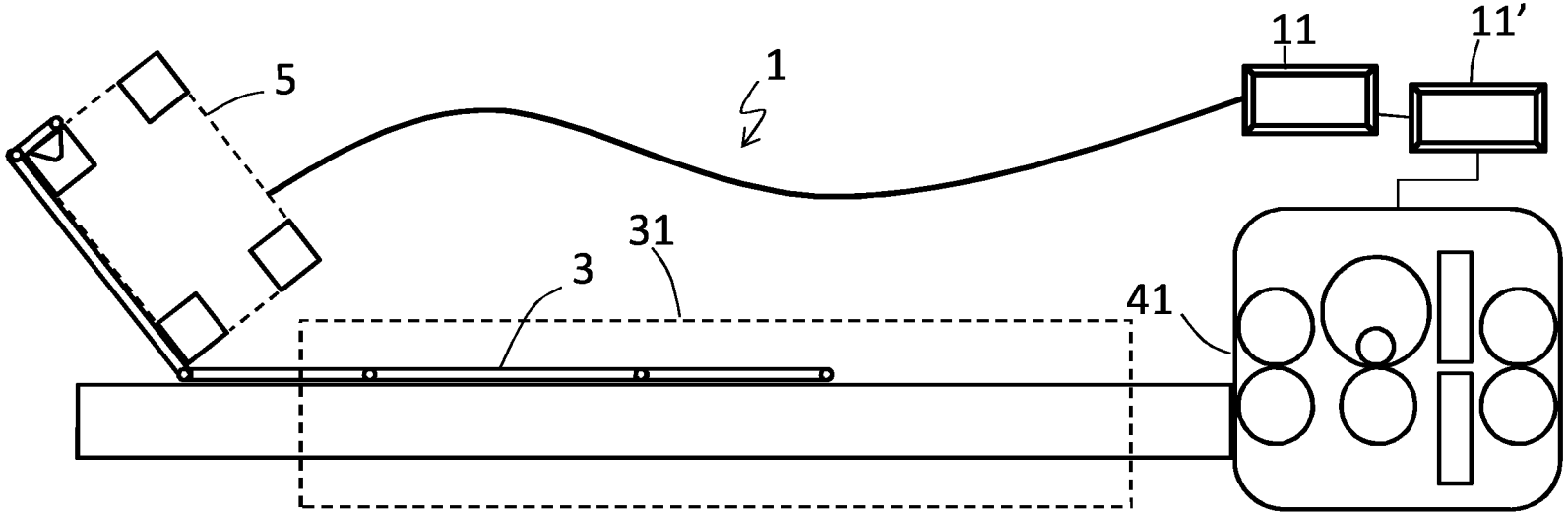
Figure 3C:
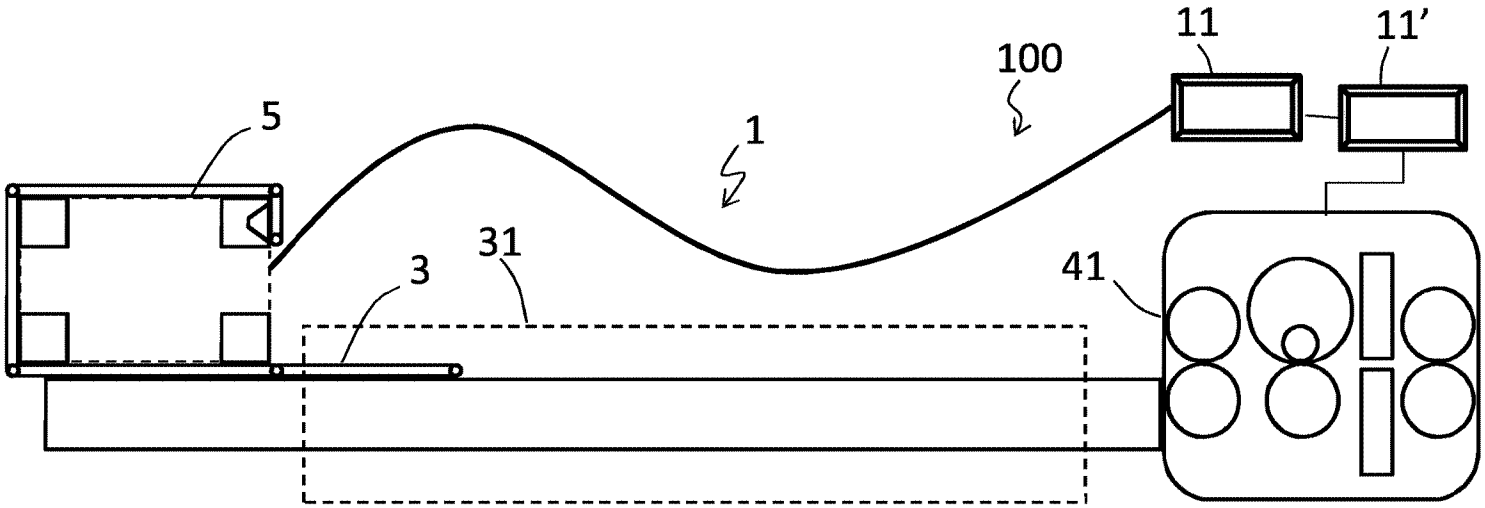
Figure 3D:
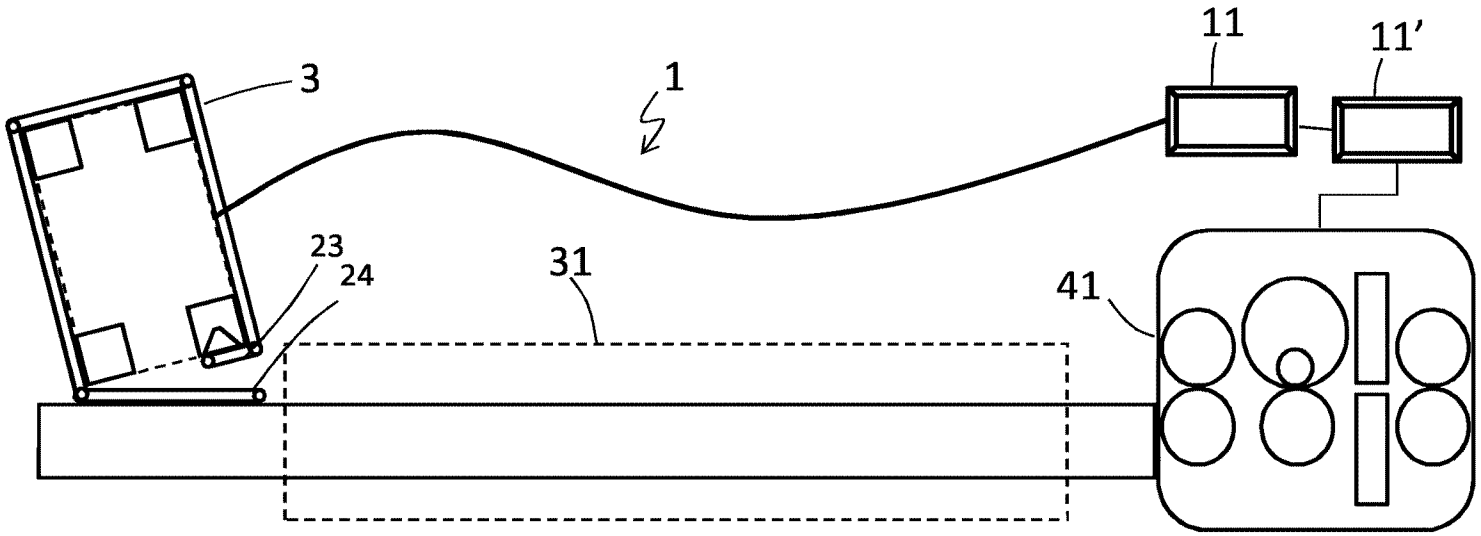

FIG. 3*d* shows schematically the box erecting system 1 in a position where a box template 3 has been almost wrapped around the frame 5. In this embodiment, where a glue tab is provided as a first end 23 of the box template 3 which is attached to the attaching device 19 of the frame 5, glue is being provided to either the glue tab or a second end 24 of the box template 3 which will be mating with the glue tab 23 when the box template is completely wrapped around the frame. The sealing between the glue tab 23 and the second end 24 of the box template is referred to as the manufacturer's joint. Hereby in this embodiment of the invention the method comprises a step of sealing a manufacturer's joint before the frame is separated from the box template. The box erecting system comprises hereby as described above a gluing device 51. The gluing device 51 is connected to the control system 11 and is controlled by the control system 11 to eject glue to the box template for the sealing of both the manufacturer's joint and the bottom. Glue is provided to either a first or a second end of the box template and either the first or the second bottom flaps 28, 29 when they are passing the gluing device 51 on its way through the feeding part 31.

Figure 4:
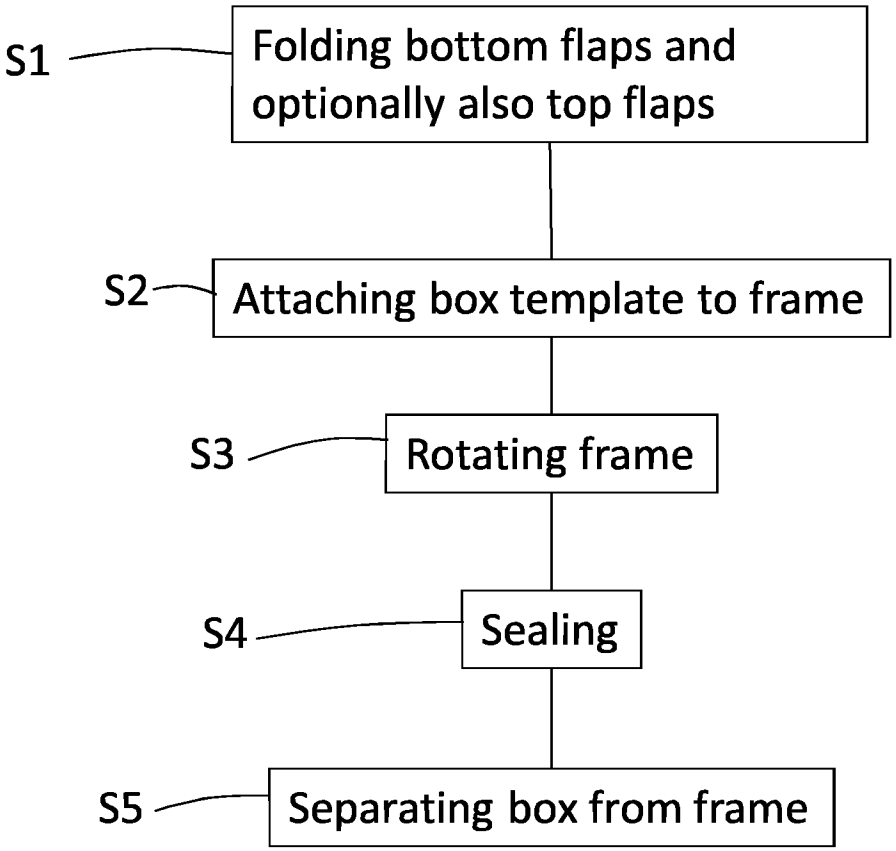
FIG. 4 is a flow chart of a method according to one embodiment of the invention.

In FIG. 4 a flow chart of the method to erect a box according to one embodiment of the invention is shown. The steps of the method are described briefly below. Most of the method steps have already been described in detail above.

S1: Folding first and second bottom flaps 28, 29 in relation to an adjacent side wall part 108, 109 of the box template 3. The folding can be between 60-90 degrees and in one embodiment between 80-90 degrees. Optionally also top flaps 48, 49 can be folded however in the opposite direction from the folding of the bottom flaps. Suitably this step of folding the bottom flaps 28, 29 also comprises folding the two first bottom flaps 28 a different amount of degrees than the two second bottom flaps 29 are folded.

S2: Attaching a first end 23 of the box template 3 to a frame 5 of the box erecting system 1.

S3: Rotating the frame 5 to wrap the box template 3 around the frame.

S4: Sealing a manufacturer's joint and a bottom of the box before it is separated from the frame. Sealing may comprise to provide glue to a first end 23 or a second end 24 of the box template and to either the first or the second bottom flaps 28, 29 and possibly also to compress the first and second bottom flaps towards each other and compress the manufacturer's joint.

S5: Separating the erected box from the frame such that another box can be erected.

According to another aspect of the invention a method for producing boxes from sheet material is provided. The sheet material can be for example cardboard or corrugated board. The method comprises the steps of:

producing box templates, possibly of different sizes, from sheet material;

erecting the box templates according to any one of the embodiments of the methods for erecting boxes as described above.

The method can further comprise an initial step of providing the sheet material to a box template production system from bales of fanfolded sheet material. When the box templates are produced from fanfolded material, such as for example fanfolded corrugated board, folds will be provided in the box templates also at other positions than intended, here called fanfold folds. These fanfold folds can be problematic to handle when erecting the boxes because the box walls may not behave as walls without such fanfold folds. They may fold along a fanfold fold rather than along intended crease lines. Ensuring corner folding in intended positions is crucial to ensure a correct box erection. The use of the frame and the method of wrapping the box templates around the frame for erecting the boxes will be especially suitable for and improve erection processes of box templates comprising fanfold folds, i.e. box templates provided in different sizes on demand from fanfolded sheet material. Such a fanfold fold 140 is shown in the box template 3 which is erected by the box erecting system 1 shown in FIG. 1*c*. The sheet material could also be provided to the box template production system from sheet material rolls or from any other form of sheet material storage. Corrugated board provided in rolls can for example be single phase corrugated board. The storage of sheet material on rolls may cause instability of side walls and therefore the use of the frame and the method of folding a bottom before wrapping the box templates around the frame for erecting the boxes will be advantageous also when using sheet material provided from such rolls.

According to one embodiment of the invention the method for producing boxes further comprises synchronizing a control system 11 of the box erecting system 1 with a control system 11' of the converter part 41 such that the wrapping of a box template 3 around the frame 5 is synchronized with conversion of sheet material into a box template in the converter part 41, whereby the whole process from sheet material to an erected box is a continuous process. These two control systems 11, 11' can also be combined into one control system.

According to another aspect of the invention a box production system 100 is provided. Such a box production system is as already described schematically shown in FIGS. 3*a*-3*d*. The box production system comprises:

at least one inlet 45 for receiving sheet material;

at least one converter part 41 configured for receiving said sheet material and convert said sheet material into box templates, possibly of different sizes, according to given instructions;

at least one box erecting system 1 as described above configured for erecting box templates provided from the at least one converter part 41.

In one embodiment of the invention said at least one inlet 45 is configured for receiving said sheet material from bales of fanfolded sheet material or from sheet material rolls as described above.

In one embodiment of the invention the control system 11 of the box erecting system 1 is synchronized or integrated with a control system of the converter part 41 such that the wrapping of a box template 3 around the frame 5 is synchronized with conversion of sheet material into a box template in the converter part 41, whereby the whole process from sheet material to an erected box is a continuous process.

The control system 11 of the box erecting system 1 comprises further a processor and a computer program which when run on the processor causes the control system 11 to perform the method for erecting boxes as described above.

The invention comprises further a computer program comprising computer readable code which, when run on a processor in a control system 11 of a box erecting system 1 according to the invention causes the control system to perform the box erecting method of the invention as described above.

What is claimed is:

1. A method for erecting a box from a box template, said method comprising:

folding two first bottom flaps and two second bottom flaps of the box template, the first and second bottom flaps being configured to form a bottom of the box when it is erected and the two first bottom flaps are opposing each other and the two second bottom flaps are opposing each other in the box when it is erected;

attaching the box template to a frame;

rotating the frame to wrap the box template around the frame; and securing a manufacturer's joint and a bottom of the box before the erected box is separated from the frame.

2. A method according to claim 1, wherein folding the two first bottom flaps and the two second bottom flaps comprises folding the two first bottom flaps a first amount and folding the two second bottom flaps a second amount that is different than the first amount.

3. A method according to claim 1, wherein folding first and second bottom flaps of the box template comprises advancing the box template through a feeding part of a box erecting system towards the frame such that a first guiding device provided in the feeding part will force the first and second bottom flaps to fold between 60 and 90 degrees in relation to an adjacent side wall part of the box template.

4. A method according to claim 1, wherein, prior to rotating the frame to wrap the box template around the frame, the method further comprises:

folding two first top flaps and two second top flaps of the box template, the first and second top flaps being configured to form a top of the box when it is erected and closed and the two first top flaps are opposing each other and the two second top flaps are opposing each other in the box when it is erected, wherein the first and second top flaps are folded in relation to an adjacent side wall part of the box template and in an opposite direction compared to the folding of the bottom flaps.

5. A method according to claim 1, wherein sealing a manufacturer's joint and a bottom of the box comprises providing glue to a first end or a second end of the box template and to the first or the second bottom flaps before the box template has been completely wrapped around the frame and compressing the manufacturer's joint and compressing the first bottom flaps towards the second bottom flaps to seal the bottom.

6. A method according to claim 1, wherein attaching the box template to the frame comprises attaching a first end of the box template to one of four corner posts provided in the frame.

7. A method according claim 1, further comprising:

adjusting a size of the frame according to a size of the box template before the box template is wrapped around the frame.

8. A method according to claim 7, wherein adjusting the size of the frame comprises controlling the size of the frame by a control system connected to the frame, wherein said adjusting comprises controlling by distances between four corner posts provided in the frame.

9. A method according to claim 1, further comprising:

adjusting a position of a first guiding device and a second guiding device of a feeding part of a box erecting system before the box template is advanced through the feeding part, said position is adjusted according to a height of side walls of the box template, which height corresponds to a height of the finally erected box.

10. A method according to claim 1, wherein the method further comprises positioning a distant end of the frame substantially in line with bottom flap creases of the box template such that a bottom can be folded while keeping the frame inside the wrapped box template.

11. A computer program comprising computer readable code which, when run on a processor in a control system of a box erecting system causes the control system to perform a method as claimed in claim 1.

12. A method for producing boxes from sheet material, said method comprising:

producing box templates from sheet material;

erecting the box templates according to the method in claim 1.

13. A method according to claim 12, further comprising providing the sheet material to a converter part of a box production system from bales of fanfolded sheet material or from sheet material rolls.

14. A method according to claim 12, further comprising synchronizing a control system of the box erecting system with a control system of the converter part such that the wrapping of a box template around the frame is synchronized with conversion of sheet material into a box template in the converter part, whereby the whole process from sheet material to an erected box is a continuous process.

15. A box erecting system for erecting a box from a box template, said box erecting system comprising:

a frame;

an attaching device connected to the frame and configured for attaching the frame to a first end of a box template to be erected;

a control system connected to said frame and configured for rotating said frame for wrapping a box template attached to the frame around the frame;

a first guiding device arranged in the box erecting system for folding two first bottom flaps and two second bottom flaps of the box template before the box template is wrapped around the frame, the first and second bottom flaps being configured to form a bottom of the box when it is erected and the two first bottom flaps are opposing each other and the two second bottom flaps are opposing each other in the box when it is erected.

16. A box erecting system according to claim 15, further comprising an advancing device provided in a feeding part of the box erecting system for advancing the box template along a path of the feeding part towards the frame, wherein the frame is provided at an outlet side of the feeding part and wherein the first guiding device is arranged relative to said feeding part such that the first guiding device will force the first and second bottom flaps to fold between 60 and 90 degrees in relation to an adjacent side wall part of the box template when the box template is fed through the feeding part.

17. A box erecting system according to claim 15, further comprising at least one actuator provided to the feeding part and configured for providing an additional amount of folding to either the two first bottom flaps or the two second bottom flaps when the box template is fed through the feeding part.

18. A box erecting system according to claim 15, further comprising a second guiding device provided in a feeding part of the box erecting system and configured for folding two first top flaps and two second top flaps of the box template before the box template is wrapped around the frame, the first and second top flaps are configured to form a top of the box when it is erected and closed and the two first top flaps are opposing each other and the two second top flaps are opposing each other in the box when it is erected, wherein the first and second top flaps are configured to be folded in relation to adjacent side wall parts of the box template and in an opposite direction compared to the folding of the bottom flaps.

19. A box erecting system according to claim 15, further comprising a gluing device configured for providing glue to a first end or a second end of the box template and to at least one of the first or the second bottom flaps before the box template has been completely wrapped around the frame.

20. A box erecting system according to claim 15, wherein the frame comprises adjustable parts defining a size of the frame and the control system is configured for adjusting the size of the frame by adjusting said adjustable parts according to a size of a box template which should be erected.

21. A box erecting system according to claim 15, wherein the adjustable parts of the frame comprise four corner posts, wherein the control system is configured for controlling the position of said corner posts for different box sizes to be erected.

22. A box erecting system according to claim 21, wherein each corner post will be provided in a corner between two side walls of the wrapped box and an adjustment of the size of the frame is provided by adjusting distances between the corner posts, which distances correspond to a width and a length of the box to be erected.

23. A box erecting system according to claim 21, wherein at least one of the corner posts comprises an attachment device to which a first end of a box template can be attached during wrapping of the box template around the frame.

24. A box erecting system according to claim 15, wherein the control system is configured for providing the frame to the box template with a distal end of the frame substantially in line with bottom flap creases of the box template such that a bottom can be folded while keeping the frame inside the wrapped box template.

25. A box erecting system according to claim 15, wherein the control system is configured for controlling the position of the first guiding device and a second guiding device of a feeding part of the box erecting system before the box template is advanced through the feeding part, said position is adjusted according to a height of side walls of the box template, which height corresponds to a height of the finally erected box.

26. A box erecting system according to claim 15, wherein said control system comprises a processor and a computer program which when run on the processor causes the control system to perform a method as claimed in any one of the claims 1-10.

27. A box production system comprising:

at least one inlet for receiving sheet material;

at least one converter part configured for receiving said sheet material and convert said sheet material into box templates according to given instructions;

at least one box erecting system according to claim 15 configured for erecting box templates provided from the at least one converter part.

28. A box production system according to claim 27, wherein said at least one inlet is configured for receiving said sheet material from bales of fanfolded sheet material or from sheet material rolls.

29. A box production system according to claim 27, wherein the control system of the box erecting system is synchronized or integrated with a control system of the converter part such that the wrapping of a box template around the frame is synchronized with conversion of sheet material into a box template in the converter part, whereby the whole process from sheet material to an erected box is a continuous process.

30. A method for erecting a box from a box template, said method comprising:

folding two first bottom flaps and two second bottom flaps of the box template, the first and second bottom flaps being configured to form a bottom of the box when it is erected and the two first bottom flaps are opposing each other and the two second bottom flaps are opposing each other in the box when it is erected, folding the two first bottom flaps and the two second bottom flaps comprising folding the two first bottom flaps a first amount and folding the two second bottom flaps a second amount that is different than the first amount;

attaching the box template to a frame; and rotating the frame to wrap the box template around the frame.

31. A method for erecting a box from a box template, said method comprising:

adjusting a position of a first guiding device and a second guiding device of a feeding part of a box erecting system before the box template is advanced through the feeding part, said position is adjusted according to a height of side walls of the box template, which height corresponds to a height of the finally erected box folding two first bottom flaps and two second bottom flaps of the box template, the first and second bottom flaps being configured to form a bottom of the box when it is erected and the two first bottom flaps are opposing each other and the two second bottom flaps are opposing each other in the box when it is erected;

attaching the box template to a frame; and rotating the frame to wrap the box template around the frame.

* * * * *